US010711405B2

(12) United States Patent
Lawler et al.

(10) Patent No.: US 10,711,405 B2
(45) **Date of Patent: *Jul. 14, 2020**

(54) FIBERGLASS GUARD RAIL

(71) Applicant: ASSET INTEGRITY MANAGEMENT SOLUTIONS, L.L.C., Houston, TX (US)

(72) Inventors: Kinton Lawler, Fulshear, TX (US); Billy L. Griffith, Waller, TX (US); Mikael W. Smith, Kingwood, TX (US); Rodney H. Masters, Houston, TX (US)

(73) Assignee: ASSET INTEGRITY MANAGEMENT SOLUTIONS, L.L.C., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,682

(22) Filed: Feb. 19, 2019

(65) Prior Publication Data

US 2019/0186079 A1 Jun. 20, 2019

Related U.S. Application Data

(63) Continuation of application No. 15/829,674, filed on Dec. 1, 2017, now Pat. No. 10,208,430.

(60) Provisional application No. 62/569,290, filed on Oct. 6, 2017.

(51) Int. Cl.

| | |
|---|---|
| ***E01F 15/00*** | (2006.01) |
| ***E01B 5/18*** | (2006.01) |
| ***E01F 15/04*** | (2006.01) |

(52) U.S. Cl.

CPC ..... *E01B 5/18* (2013.01); *E01F 15/043* (2013.01); *E01F 15/0453* (2013.01); *E01F 15/0461* (2013.01)

(58) Field of Classification Search

CPC ..... E01B 5/18; E01F 15/043; E01F 15/0453; E01F 15/0461

USPC ..... 404/6–10; 256/13.1

See application file for complete search history.

(56) References Cited

U.S. PATENT DOCUMENTS

| | | | | |
|---|---|---|---|---|
| 4,666,130 | A | 5/1987 | Denman et al. | |
| 5,028,463 | A | 7/1991 | Cahill et al. | |
| 5,261,647 | A | 11/1993 | Venegas, Jr. et al. | |
| 5,443,324 | A | 8/1995 | Sullivan | |
| 5,876,020 | A | 3/1999 | Giavotto | |
| 6,149,134 | A | 11/2000 | Bank et al. | |
| 7,445,402 | B1 | 11/2008 | Chen | |
| 8,807,864 | B2 * | 8/2014 | Kulkarni | E01F 15/043 404/10 |

OTHER PUBLICATIONS

International Search Report and Written Opinion for Int'l Application No. PCT/US2018/053695, dated Nov. 30, 2018.

* cited by examiner

*Primary Examiner* — Raymond W Addie
(74) *Attorney, Agent, or Firm* — Edmonds & Cmaidalka, P.C.

(57) ABSTRACT

A guardrail system for use along a roadway. The system can include a longitudinal body having one or more longitudinal void spaces formed therein, at least one substantially vertical post connected at one or both ends of the body, and a longitudinal member disposed within any one of the longitudinal void spaces of the body having a crosswise ultimate tensile strength that is at least 20% greater than the crosswise ultimate tensile strength of the longitudinal body.

22 Claims, 28 Drawing Sheets

FIBERGLASS GUARD RAIL

CROSS-REFERENCE TO RELATED APPLICATION

This application claims priority to U.S. Provisional Patent Application having Ser. No. 62/569,290, filed on Oct. 6, 2017, and U.S. patent application having Ser. No. 15/829,674, filed on Dec. 1, 2017, now issued as U.S. Pat. No. 10,208,430, which are both incorporated by reference herein in their entireties.

BACKGROUND

Field

Embodiments described generally relate to guard rails. More particularly, such embodiments relate to highway guard rails.

Description of the Related Art

Guard rails are a safety barrier intended to shield a motorist who has left the roadway. Guard rails are typically made of galvanized beams that are designed to deflect or redirect a vehicle back to the roadway or slow the vehicle down to a complete stop.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
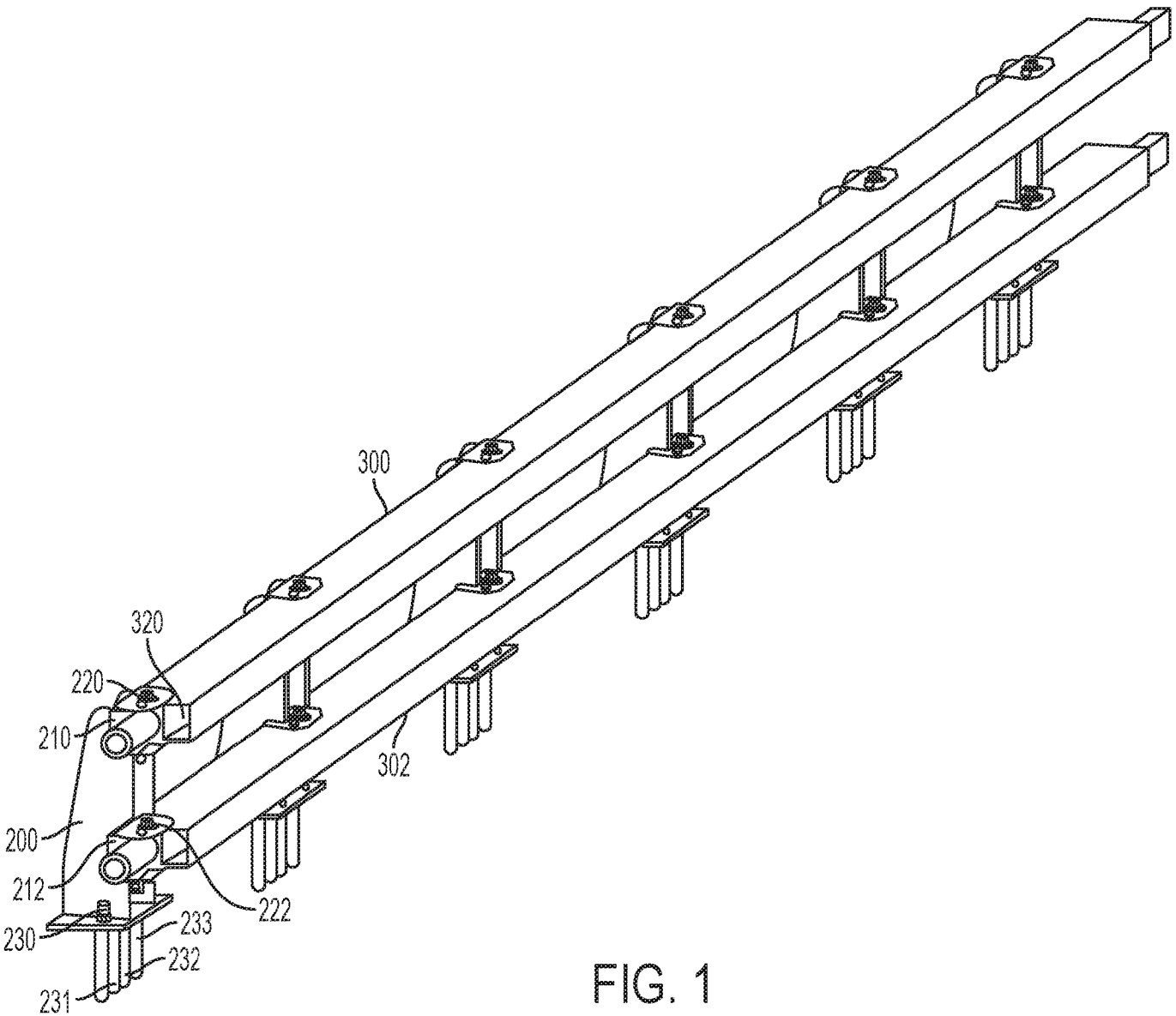
FIG. 1 depicts a partial perspective view of an illustrative guardrail system, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

Further, the terms "guardrail" or "guardrails" and "barrier" or "barriers" may be used throughout this application to include any type of guardrail and/or barrier which may be formed at least in part using cables, guardrails and support posts incorporating teachings of the present invention. The term "road" or "roadway" may be used throughout this application to include any highway, roadway or path satisfactory for vehicle traffic. Guardrails and barriers incorporating teachings of the present invention may be installed in median strips or along shoulders of highways, roadways or any other path which is likely to encounter vehicular traffic.

FIG. 1 depicts a partial perspective view of an illustrative fiberglass guardrail system 100, according to one or more embodiments. The guardrail system 100 can include a post 200, and a longitudinal body or rails 300, 302. As also seen in FIGS. 18-23, the post 200 can have one or more channels 210, 212. The channels 210, 212 can be cutouts. The channel cutouts 210, 212 can be C-shaped, U-shaped, V-shaped, or any other shape capable of receiving the rail 300 within. The entire rails 300, 302 can nest within the cutout or a portion of the rail can overhang the edge of the channel. Alternatively, the channels can be entirely disposed within the post 200. Channels entirely disposed with the post 200 can be cylindrical, rectangular cuboid, triangular prism, square cuboid or any other shape capable of receiving the body within. The number of channels 210, 212 can match the number of rails 300, 302. There can be 1, 2, 3, 4 or more channels 210, 212 and rails 300, 302. The channels 210, 212 can have holes 202, 204, 206 in the top of the channel and holes 207, 208, 209 in the bottom of the channel. The post 200 can be fabricated from any number of materials including, aluminum, steel, stainless steel, iron, and blends or alloys thereof, as well as other non-metallic materials including carbon fiber, fiberglass or other engineered resins.

The post 200 can be secured to a base on the roadway (not pictured) in a multitude of ways. A bolt 230, 231, 232, 233 or other mechanical fastener can be drilled or otherwise disposed through both the holes 240, 241, 242, 243 in the post 200 and the supportive base. In another embodiment, the post 200 may secure in the ground itself, without the need for the base, using concrete footings, tension anchors and cabling, or other means apparent to those skilled in the art.

Figure 2:
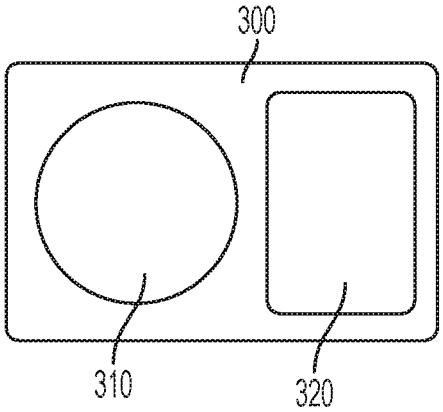
FIG. 2 depicts an illustrative cross-sectional view of the rail, according to one or more embodiments described.
Figure 3:
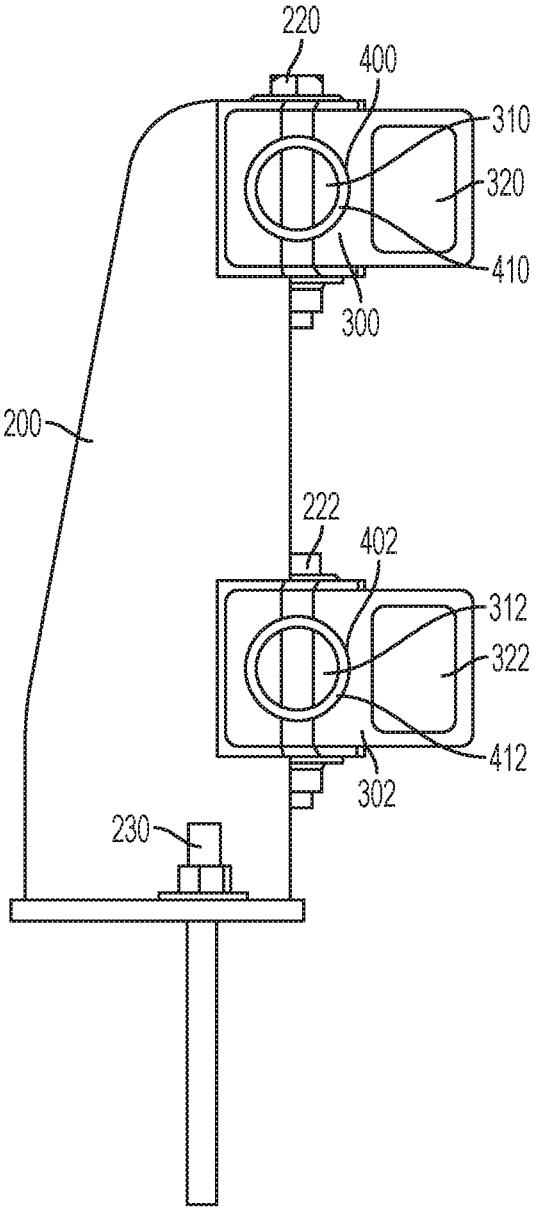
FIG. 3 depicts an illustrative cross-sectional view of the guardrail system, according to one or more embodiments described.
Figure 4:
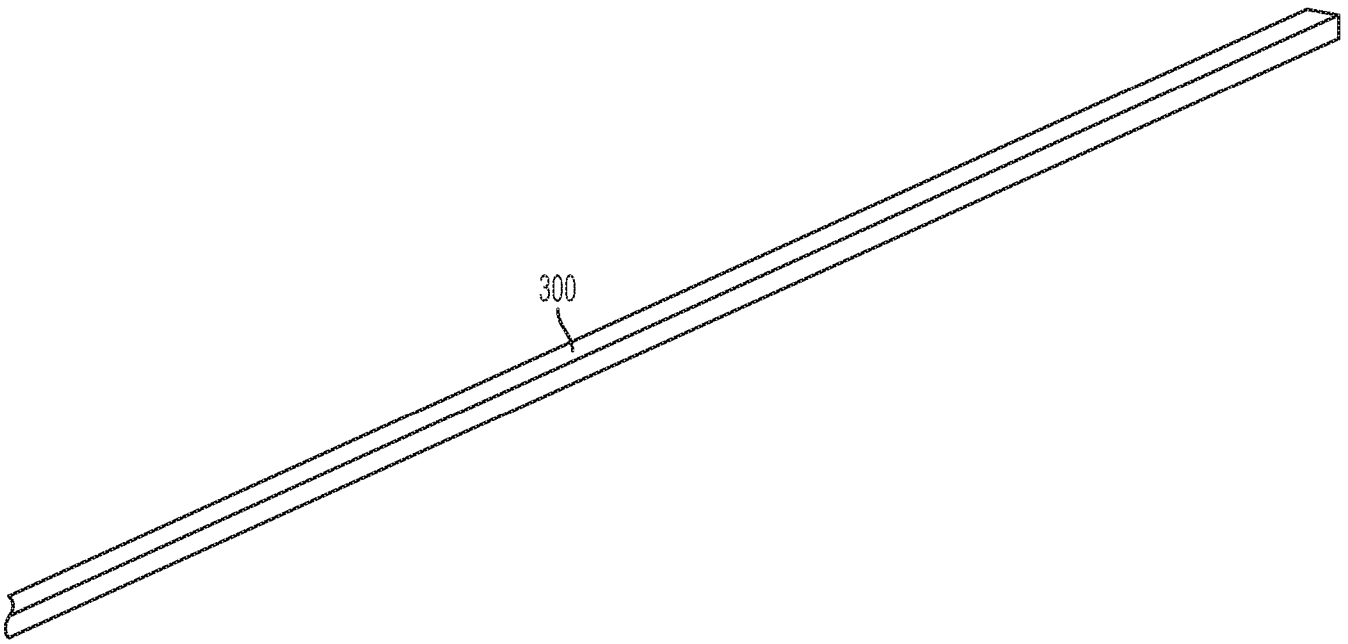
FIG. 4 depicts a partial perspective view of the rail, according to one or more embodiments described.
Figure 5:
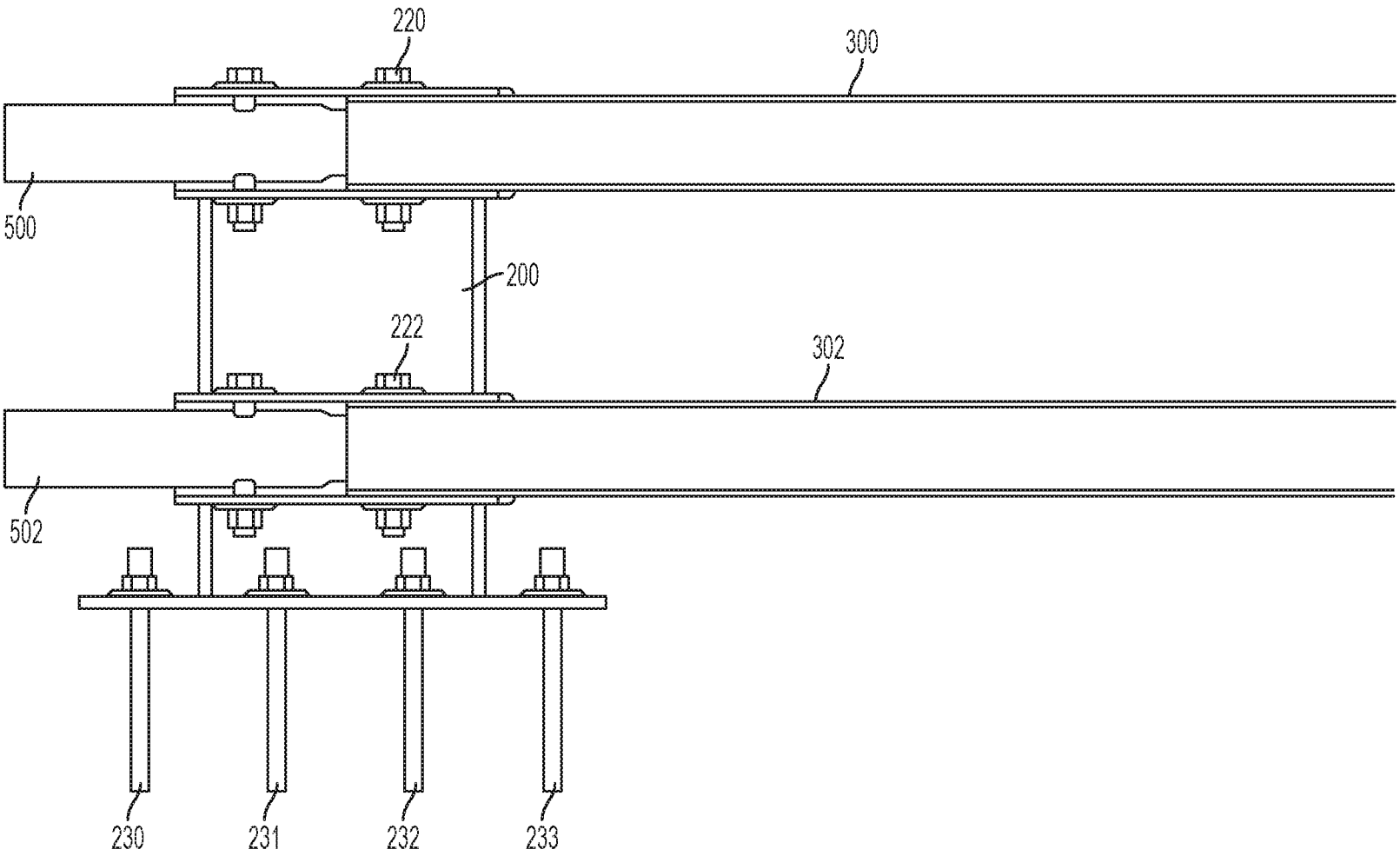
FIG. 5 depicts an illustrative schematic view of the rail secured to the post, according to one or more embodiments described.
Figure 6:
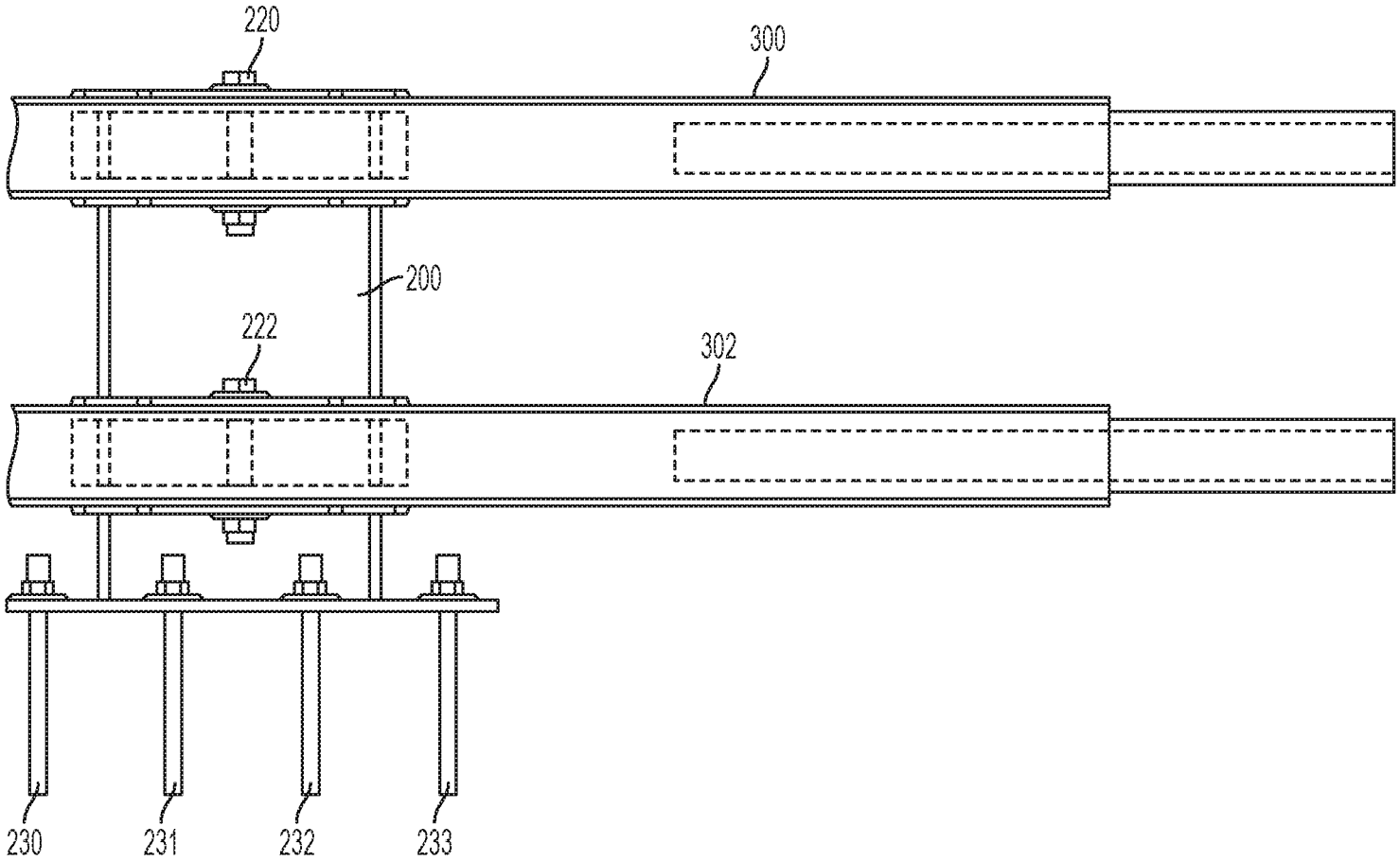
FIG. 6 depicts another illustrative schematic view of the rail secured to the post, according to one or more embodiments described.
Figure 7:
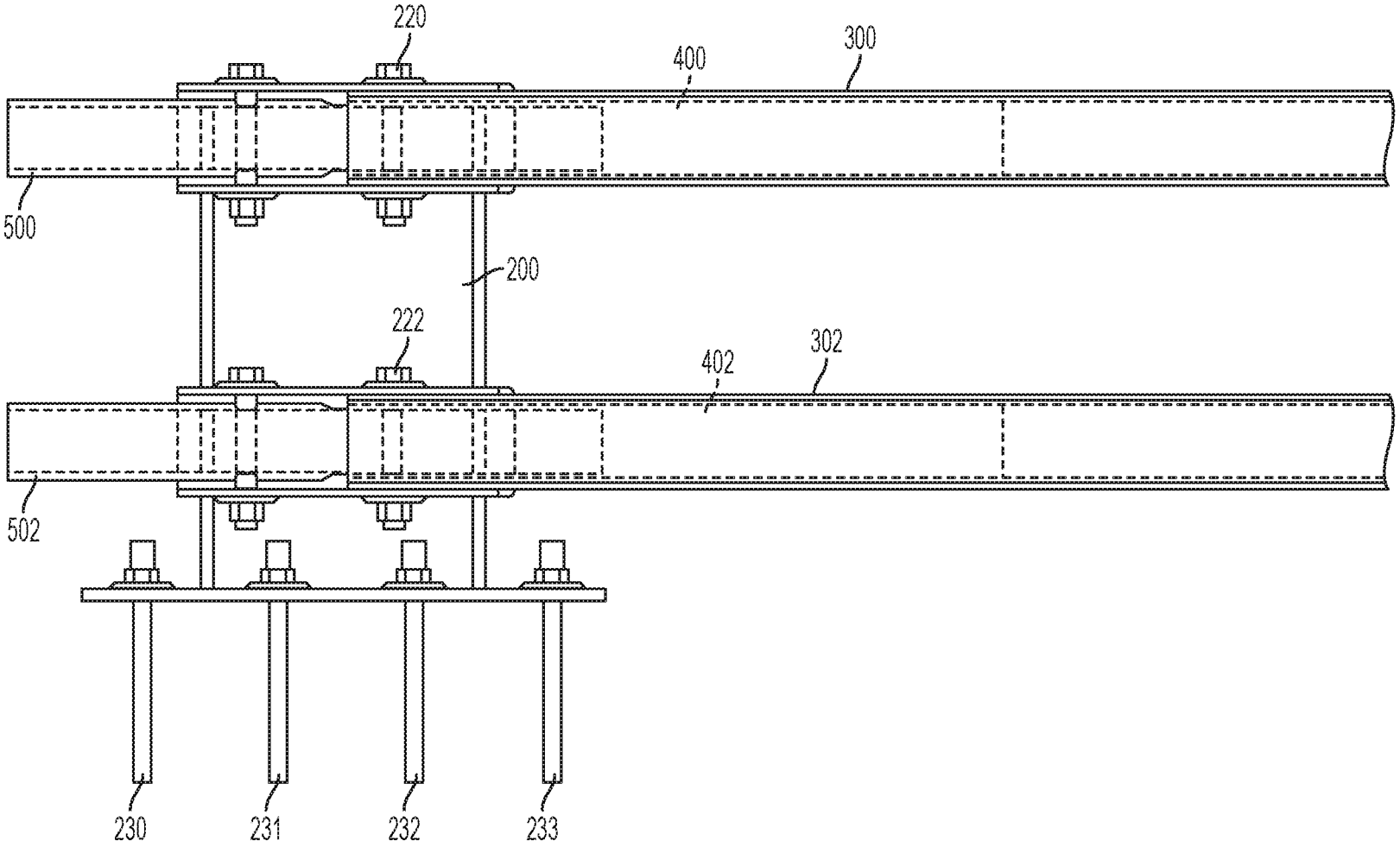
FIG. 7 depicts an illustrative schematic view of the rail secured to the post, according to one or more embodiments described.
Figure 8:
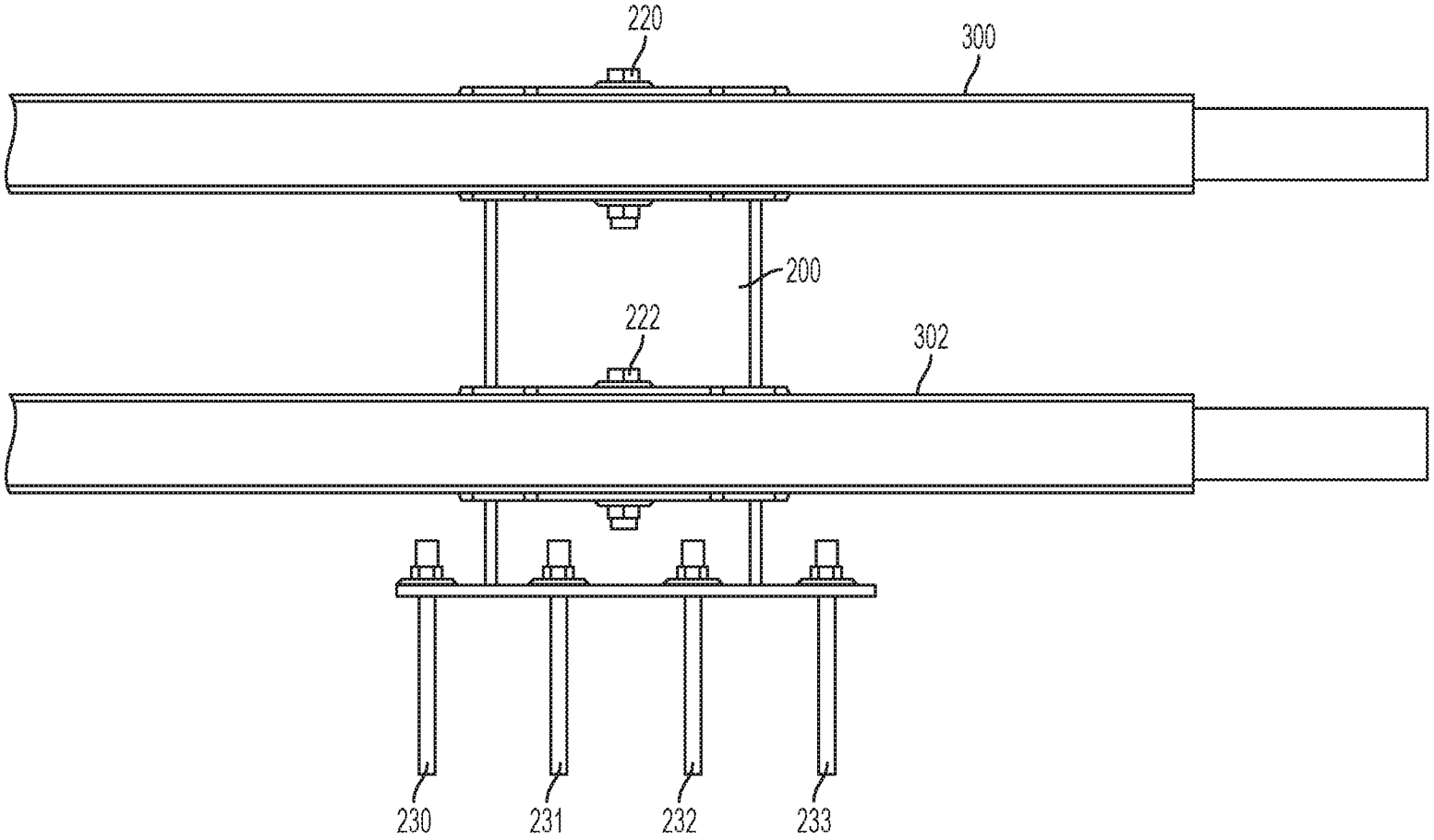
FIG. 8 depicts a side perspective view of the rail secured to the post, according to one or more embodiments described.
Figure 9:
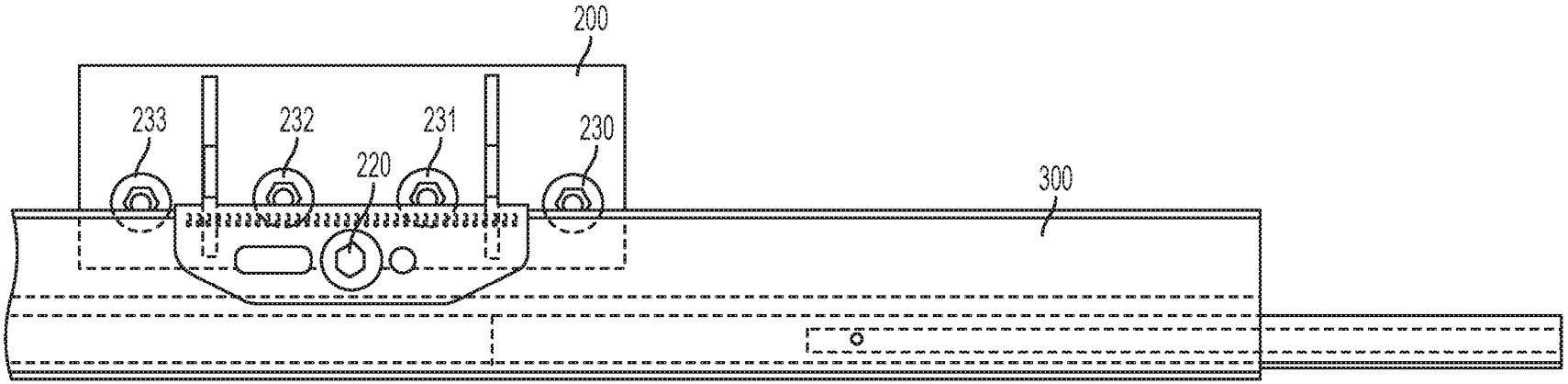
FIG. 9 depicts an elevation view of the rail secured to the post, according to one or more embodiments described.
Figure 10:
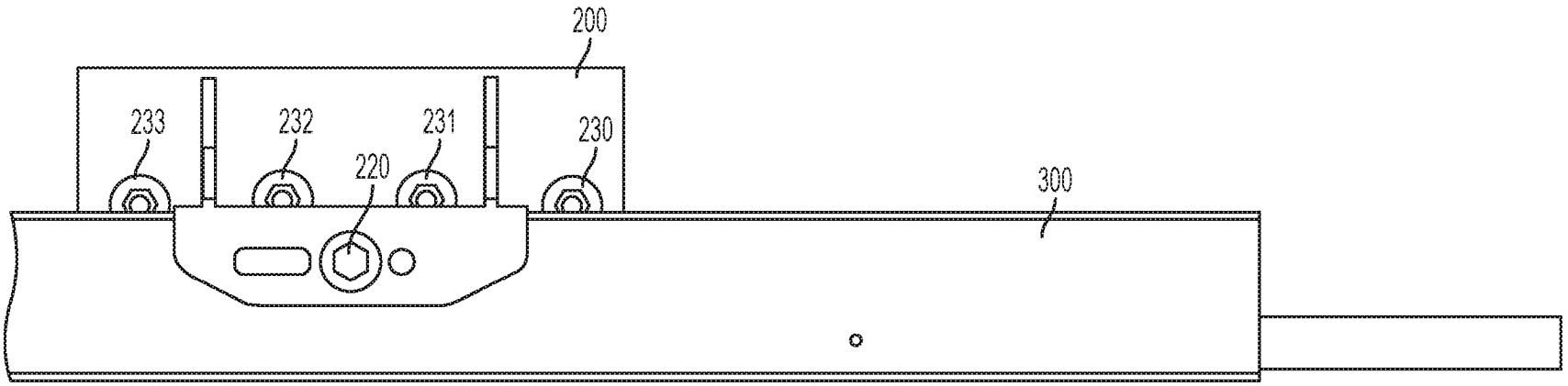
FIG. 10 depicts an elevation view of the rail secured to the post, according to one or more embodiments described.
Figure 11:
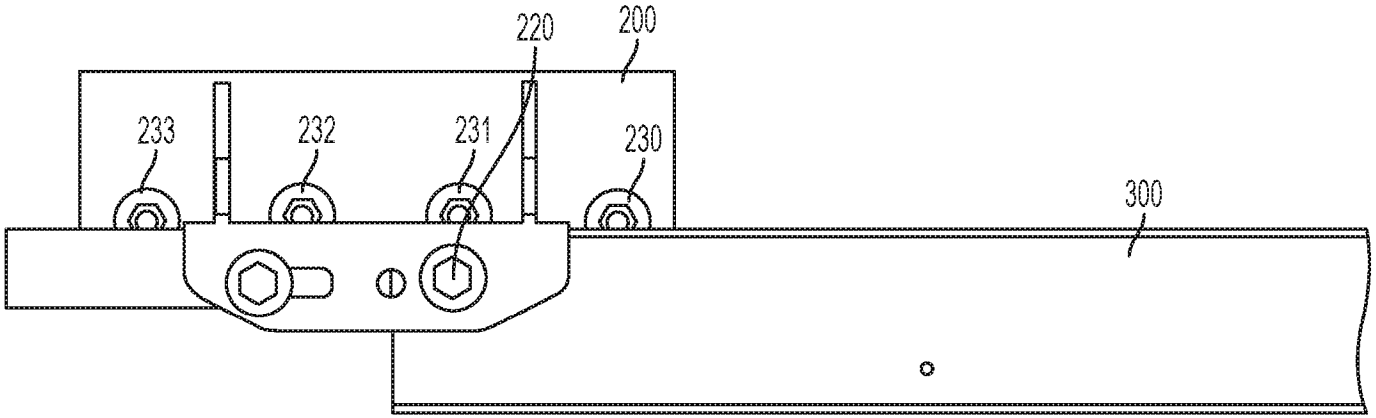
FIG. 11 depicts an elevation view of the rail secured to the post, according to one or more embodiments described.
Figure 12:
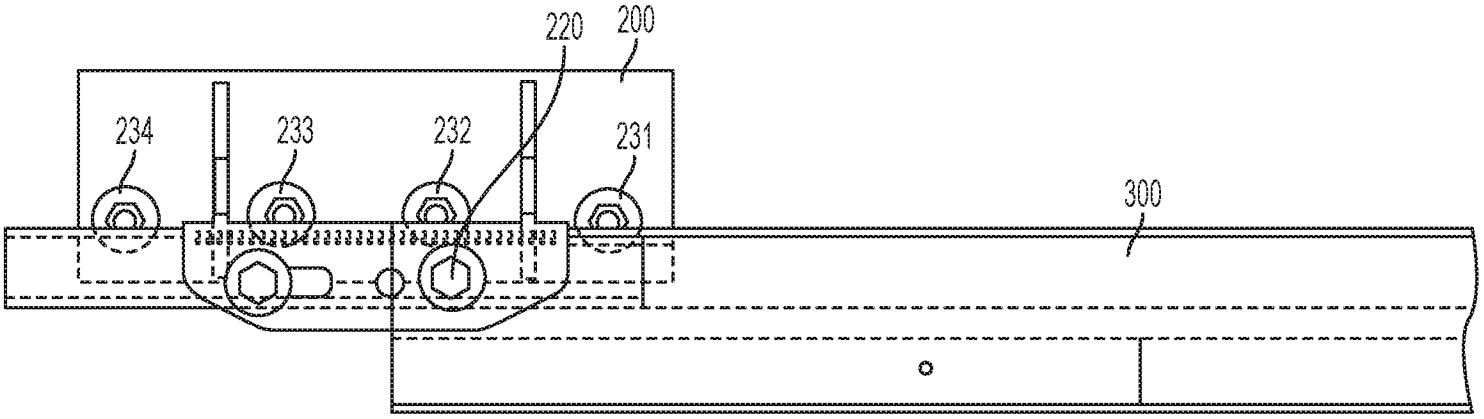
FIG. 12 depicts an elevation view of the rail secured to the post, according to one or more embodiments described.
Figure 13:
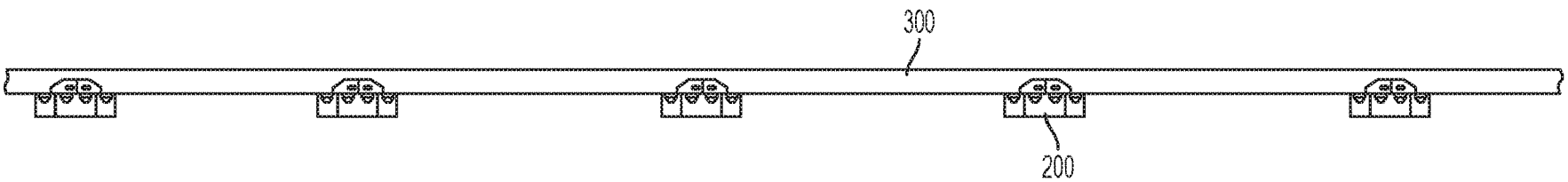
FIG. 13 depicts an elevation view of the rail secured to the post, according to one or more embodiments described.
Figure 14:
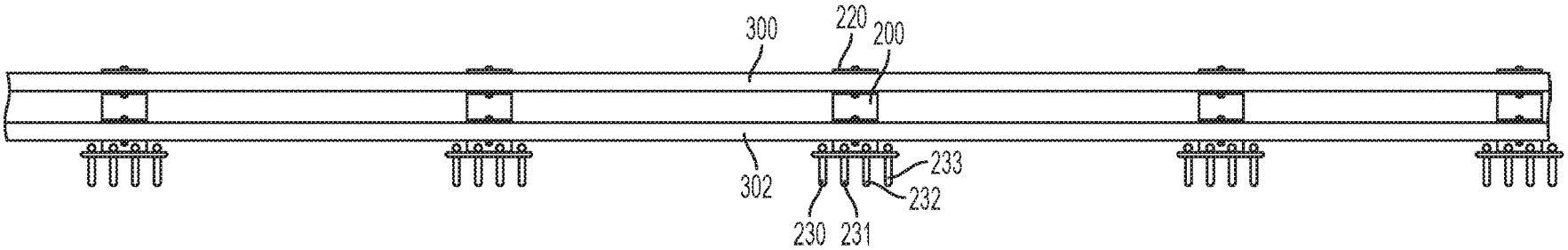
FIG. 14 depicts a side view of the of the guardrail system, according to one or more embodiments described.
Figure 15:
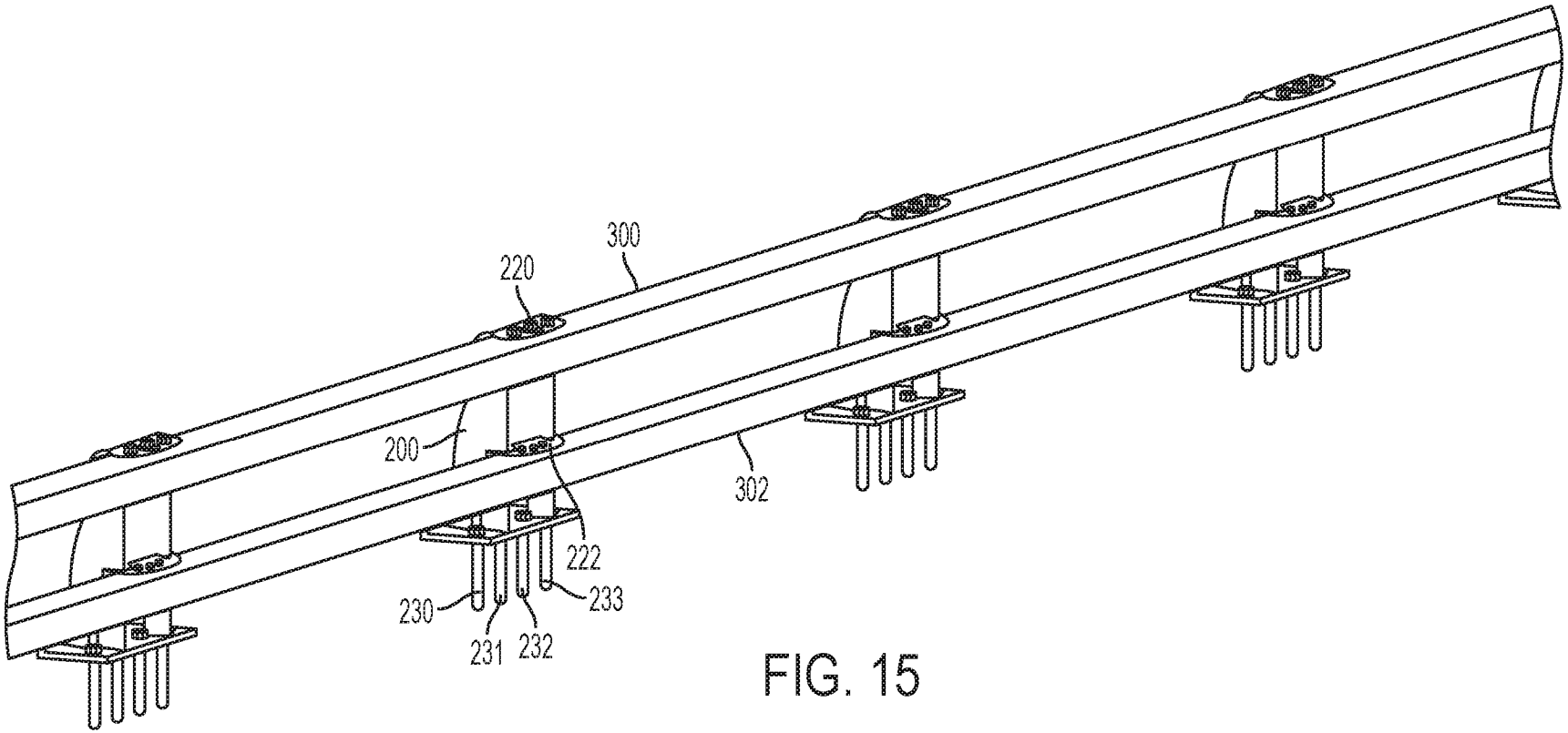
FIG. 15 depicts a side view of the guard rail system according to one or more embodiments described.
Figure 16:
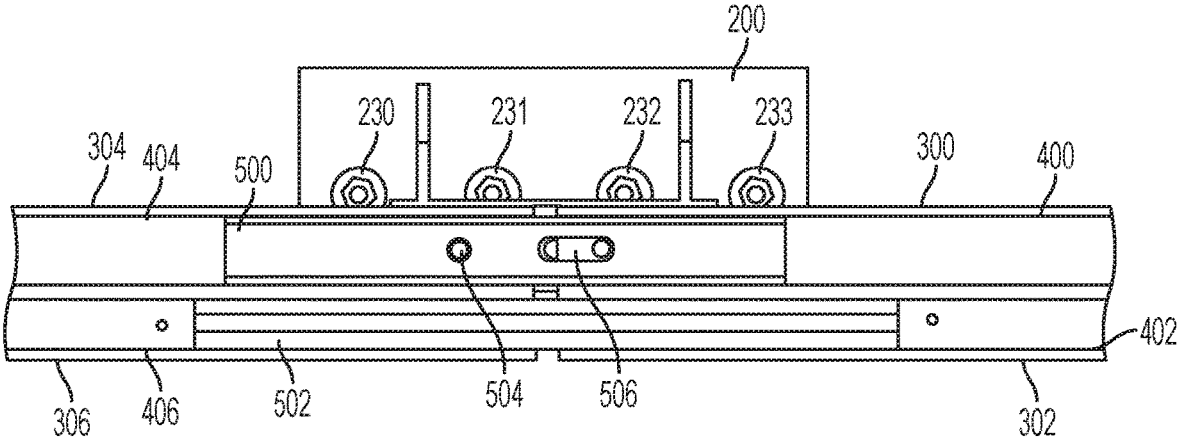
FIG. 16 depicts a cross-sectional top view of the guardrail system according to one or more embodiments described.
Figure 17:
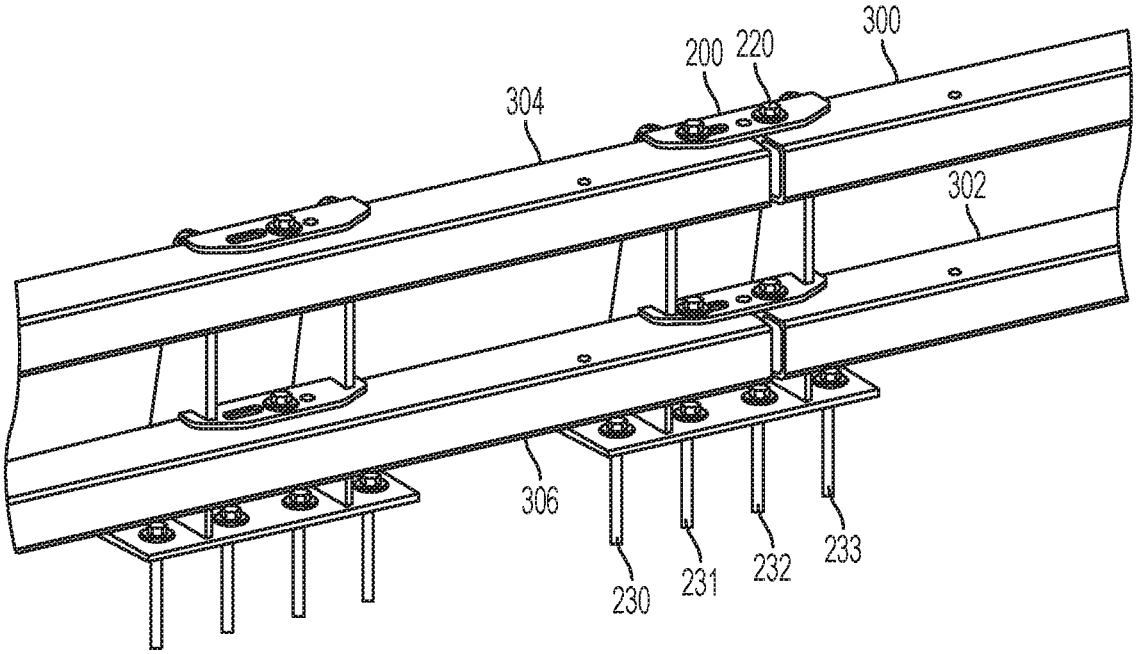
FIG. 17 depicts a partial perspective view of the guardrail system, according to one or more embodiments described.
Figure 18:
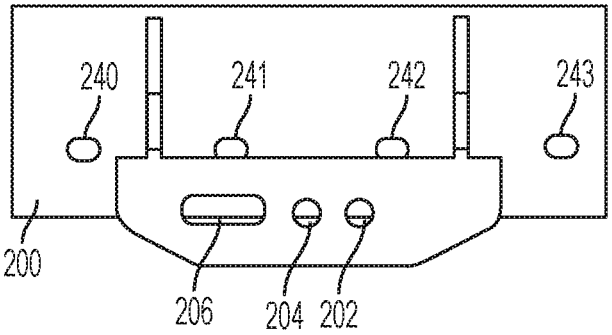
FIG. 18 depicts a top view of the post, according to one or more embodiments described.
Figure 19:
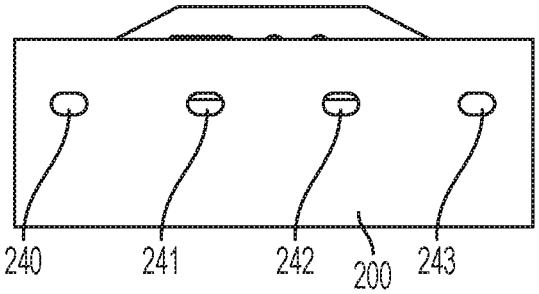
FIG. 19 depicts a bottom view of the post, according to one or more embodiments described.
Figure 20:
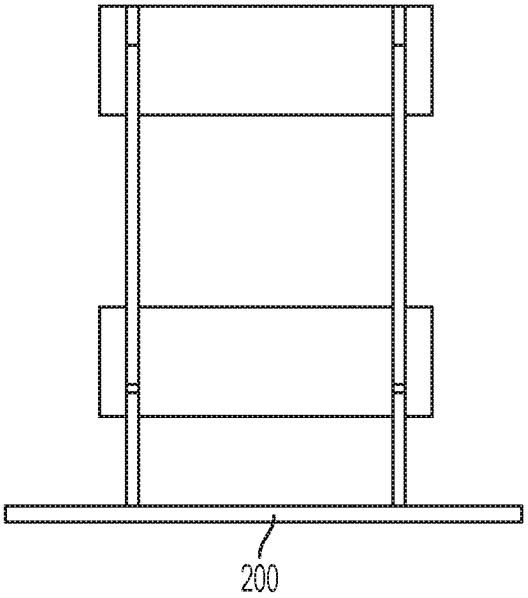
FIG. 20 depicts a back view of the post, according to one or more embodiments described.
Figure 21:
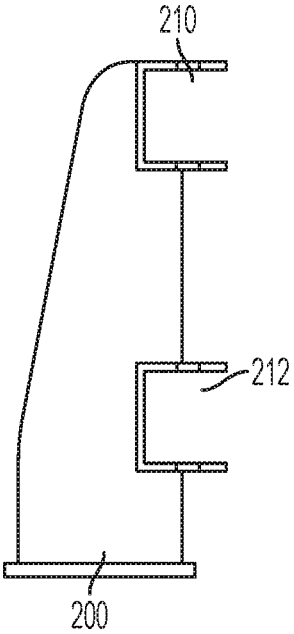
FIG. 21 depicts a side view of the post, according to one or more embodiments described.
Figure 22:
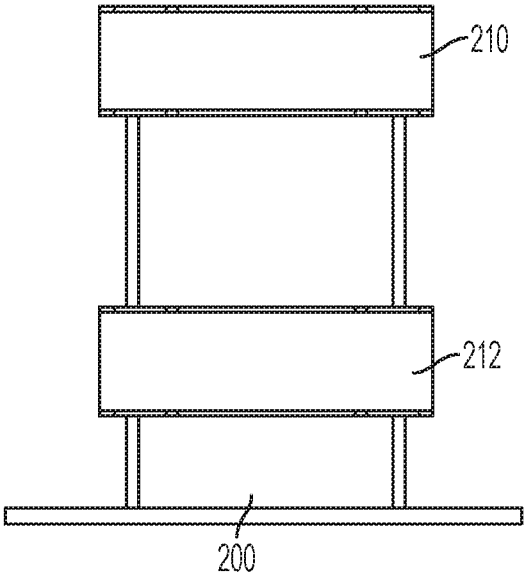
FIG. 22 depicts a front view of the post, according to one or more embodiments described.
Figure 23:
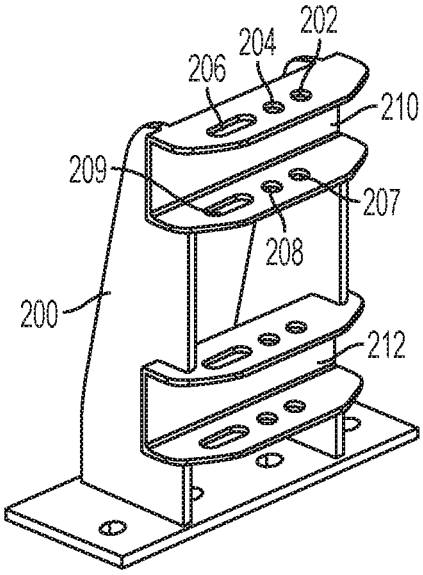
FIG. 23 depicts a perspective view of the post, according to one or more embodiments described.
Figure 24:
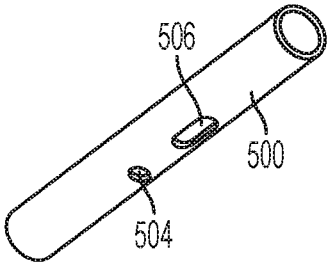
FIG. 24 depicts a perspective view of the splicer, according to one or more embodiments described.
Figure 25:
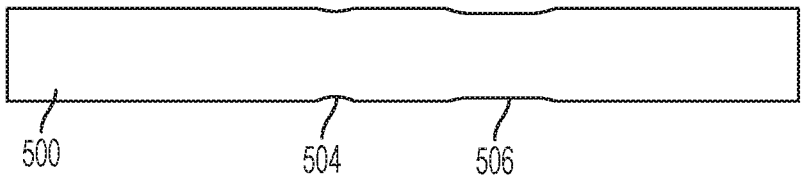
FIG. 25 depicts a side view of the splicer, according to one or more embodiments described.
Figure 26:
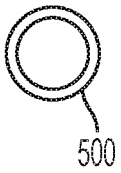
FIG. 26 depicts an end view of the splicer, according to one or more embodiments described.
Figure 27:
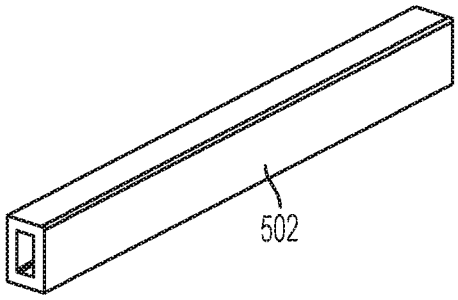
FIG. 27 depicts a perspective view of the splicer, according to one or more embodiments described.
Figure 28:
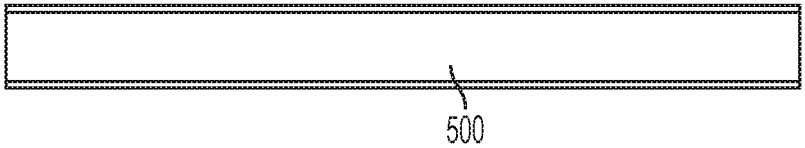
FIG. 28 depicts a side view of the splicer, according to one or more embodiments described.
Figure 29:
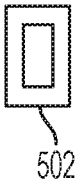
FIG. 29 depicts an end view of the splicer, according to one or more embodiments described.

FIG. 2 depicts an illustrative cross-sectional view of the rail 300. FIG. 3 depicts a cross-sectional view of the guardrail system 100. FIG. 4 depicts an illustrative view of the rail 300. The rails 300, 302 can contain one or more longitudinal voids 310, 320. The longitudinal voids 310, 320 can be cylindrical, rectangular cuboid, triangular prism, square cuboid or any other three-dimensional shape that runs along the entire length of the body. In some embodiments, one or more of the longitudinal voids 310, 320 can contain filler material. The longitudinal voids 310, 320 can be at least 10%, 20%, 30%, 40%, 50%, 60%, 70%, 80%, 90%, 95% or 99% filled with filler material. The filler material can be a foam, epoxy, fiberglass, plastic, or combination thereof. The foam can be quantum foam, polyurethane foam (foam rubber), XPS foam, polystyrene, expanded polystyrene (EPS), phenolic, or many other manufactured foam or any combination thereof.

The rails 300, 302 can be made from one or more fiber reinforced plastics, such as one or more fiberglass composites. Any suitable material, however, can be used to fabricate the rails 300, 302. For example, suitable materials can include, but are not limited to, any one or more metals (such as aluminum, steel, stainless steel, brass, nickel), wood, other composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), and mixtures, blends, or copolymers of any and all of the foregoing materials.

The rails 300, 302 can have an ultimate lengthwise tensile strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi. The rails 300, 302 can have an ultimate lengthwise tensile strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, between 10,000 psi and 20,000 psi.

The rails 300, 302 can have an ultimate crosswise tensile strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi, or less than 5,000 psi. The rails 300, 302 can have an ultimate crosswise tensile strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, between 10,000 psi and 20,000 psi.

The rails 300, 302 can have a lengthwise flexural strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi. The rails 300, 302 can have a lengthwise flexural strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, between 10,000 psi and 20,000 psi.

The rails 300, 302 can have a crosswise flexural strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi, or less than 5,000 psi. The rails 300, 302 can have a crosswise flexural strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, or between 10,000 psi and 20,000 psi.

The rails 300, 302 can have a lengthwise yield strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi. The rails 300, 302 can have a lengthwise yield strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, between 10,000 psi and 20,000 psi.

The rails 300, 302 can have a crosswise yield strength that is less than 90,000 psi, less than 80,000 psi, less than 70,000 psi, less than 60,000 psi, less than 50,000 psi, less than 40,000 psi, less than 35,000 psi, less than 30,000 psi, less than 25,000 psi, less than 20,000 psi, less than 15,000 psi, less than 10,000 psi, or less than 5,000 psi. The rails 300, 302 can have an crosswise yield strength that is between 5,000 psi and 90,000 psi, between 5,000 psi an 80,000 psi, between 5,000 psi and 70,000 psi, between 5,000 psi and 60,000 psi, between 5,000 psi and 50,000 psi, between 5,000 psi and 40,000 psi, between 5,000 psi and 30,000 psi, between 5,000 psi and 20,000 psi, between 10,000 and 90,000 psi, between 10,000 psi an 80,000 psi, between 10,000 psi and 70,000 psi, between 10,000 psi and 60,000 psi, between 10,000 psi and 50,000 psi, between 10,000 psi and 40,000 psi, between 10,000 psi and 30,000 psi, between 10,000 psi and 20,000 psi.

Several ASTM standards are available to provide guidance on performing tensile tests and the correct test is easily ascertainable by one skilled in art depending on the material being tested. Three of the most common standards are ASTM E8 for metallic materials, ASTM D3039 for polymer matrix composite materials and ASTM D638 for unreinforced and reinforced plastics. Although there can be many variations on the standard tensile test, a tensile test most often involves loading a test specimen in a universal testing machine and applying an increasing uniaxial load to the specimen until failure occurs. The sample can be supported in the test frame any number of ways: hydraulic grips, mechanically fastened clevis grips or threaded grips. The method of gripping most often depends on the material being tested, its geometry and the capabilities of the test frame.

The rail system 100 can also include one or more longitudinal members or rods 400, 402 that are disposed within any of the longitudinal void spaces 310, 312, 320, 322. The rods 400, 402 can have a crosswise ultimate tensile strength that is at least 5%, 10%, 15%, 20%, 25%, 30%, 35%, 40%, 45%, 50%, 55%, 60%, 65%, 70%, 75%, 80%, 85%, 90%, 95%, or 100% greater than the crosswise ultimate tensile strength of the rails 300, 302. The rods 400, 402 can have a lengthwise ultimate tensile strength that is at least 5%, 10%, 15%, 20%, 25%, 30%, 35%, 40%, 45%, 50%, 55%, 60%, 65%, 70%, 75%, 80%, 85%, 90%, 95%, or 100% greater than the lengthwise ultimate tensile strength of the rails 300, 302. The rods 400, 402 can have a crosswise yield strength that is at least 5%, 10%, 15%, 20%, 25%, 30%, 35%, 40%, 45%, 50%, 55%, 60%, 65%, 70%, 75%, 80%, 85%, 90%, 95%, or 100% greater than the crosswise yield strength of the rails 300, 302. The rods 400, 402 can have a lengthwise yield strength that is at least 5%, 10%, 15%, 20%, 25%, 30%, 35%, 40%, 45%, 50%, 55%, 60%, 65%, 70%, 75%, 80%, 85%, 90%, 95%, or 100% greater than the lengthwise yield strength of the rails 300, 302.

The rods 400, 402 can have an ultimate lengthwise tensile strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have an ultimate lengthwise tensile strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can have an ultimate crosswise tensile strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have an ultimate crosswise tensile strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can have a lengthwise flexural strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have a lengthwise flexural strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can have a crosswise flexural strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have a crosswise flexural strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can have a lengthwise yield strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have a lengthwise yield strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can have a crosswise yield strength that is greater than 10,000 psi, greater than 20,000 psi, greater than 25,000 psi, greater than 30,000 psi, greater than 35,000 psi, greater than 40,000 psi, greater than 45,000 psi, greater than 50,000 psi, greater than 55,000 psi, greater than 65,000 psi, greater than 75,000 psi, or greater than 80,000 psi. The rods 400, 402 can have a crosswise yield strength that is between 10,000 psi and 90,000 psi, between 15,000 psi an 80,000 psi, between 20,000 psi and 70,000 psi, between 25,000 psi and 60,000 psi, between 25,000 psi and 70,000 psi, between 25,000 psi and 80,000 psi, between 30,000 psi and 50,000 psi, or between 30,000 psi and 60,000 psi.

The rods 400, 402 can be made from one or more metals, such as one or more stainless steels. Any suitable material, however, can be used to fabricate the rods 400, 402. For example, suitable materials can include, but are not limited to, fiber reinforced plastics, any one or more metals (such as aluminum, steel, stainless steel, brass, nickel), wood, other composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), and mixtures, blends, or copolymers of any and all of the foregoing materials. Additionally, the rods 400, 402 can be hollow.

FIGS. 5-17 illustrate the mechanisms for securing adjacent rails 300, 302, 304, 306 containing rods 400, 402, 404, 406 disposed within the longitudinal voids of the rails 300, 302, 304, 306 to the post 200, according to one or more embodiments provided herein. For example, the rails 300, 302, 404, 306 can be secured to the post 200 at the post channels 210, 212 using one or more fasteners 220, 222. The fasteners 220, 222 can be sized and shaped to fit within holes formed through the top and bottom of the channels 210, 212, and corresponding holes formed through the top and bottom of the rails 300, 302. The cross-sectional shape of the fasteners and holes described within the application are preferably round, but can be any non-round shape such as elliptical, oval, triangular, square, or other polygonal shape so as to prevent relative rotation. The elliptical holes can make it easier to align the components. It should be appreciated, however, that securing the rails 300, 302, 304, 306 posts 200, rods 400, 402, 404, 406 or splicers 500, 502 can be achieved using other fasteners and techniques, such as a rivet, nut and bolt, or the like. Additionally, the rods 400, 402, 404, 406 that are disposed within the longitudinal voids 310, 320 can be attached to the rails 300, 302, 304, 306 and post 200 using fasteners 220, 222 by aligning the holes in the rods 400, 402, 404, 406 with the holes 202, 204, 206, 207, 208, 209 formed through the channels 210, 220 and the holes in the rails 300, 302, 304, 306.

FIGS. 5-17 also illustrate mechanisms for adjoining two adjacent rail sections 300, 302, 304, 306. Two adjacent rail sections 300, 302, 304, 306 can be secured at a post 200. At least one of the rail sections 300, 302 is secured to the post 200 as illustrated above. The second rail section 304, 306 can also be secured to the post 200 using a second fastener (not shown) through a second set of holes 206 in the same post channel. The second rail section 304, 306 can either be adjacent to the first rail section 300, 302, contacting the first rail section 302, 304, or be tapered such that it can be partially disposed within the first section 302, 304. In the case where the second rail section 304, 306 is partially disposed within the first rail section 302, 304, both rail sections can be attached to the post 200 using the same fastener.

FIGS. 5-17 also illustrate mechanisms for adjoining a first rod section 400, 402 with an adjacent second rod section 404, 406. The two adjacent rod sections 400, 402, 404, 406 can be secured using a splicer 500, 502. The splicers 500, 502 are further illustrated in FIGS. 24-29. The number of splicers 500, 502 can match the number of longitudinal voids 310, 320. There can be 1, 2, 3, 4 or more splicers 500, 502 and 1, 2, 3, 4 or more longitudinal voids 310, 320. The splicers 500, 502 can slide over both adjacent rod sections 400, 402, 404, 406. Additionally, when the rod sections 400, 402, 404, 406 are hollow, the splicers 500, 502 can be disposed within one or both adjacent rod sections 400, 402, 404, 406. The splicers 500, 502 can have holes 504, 506 that can be aligned with the holes 202, 204, 206 in the post 200 and the holes in one or both rail sections 400, 402, 404, 406 to secure the splicer 500, 502 to the post 200 using the fasteners as outlined above. The splicers 500, 502 can additionally contain adhesive on the side of the splicer 500, 502 that comes into contact with the rod sections 400, 402, 404, 406 to better secure the splicer 500, 502 to the rod sections 400, 402, 404, 406. Additionally, the splicer 500, 502 can be secured to just the rail sections 400, 402, 404, 406 or to the rail sections 400, 402, 404, 406 and the rods 300, 302, 304, 306 as outlined above without being fastened to the post 200. The splicer 500, 502 can be cylindrical, rectangular cuboid, triangular prism, square cuboid or any other shape capable of fitting into longitudinal voids 310, 320. The splicers 500, 502 can be tapered, at the ends or anywhere along the length of the splicer. The splicer 500, 502 can be can be made from any of the materials described herein. If there are more than one splicer 500, 502, the splicers 500, 502 can be made out of more than one material. For example, a first splicer 500 can be stainless steel and a second splicer 502 can be fiber reinforced plastic. The rod sections 400, 402, 404, 406 themselves can additionally be secured at post 200. At least one of the rod sections 400, 402, 404, 406 can have holes to secure the rod sections 400, 402, 404, 406 to the post 200 and rail sections 300, 302, 304, 306 as illustrated above using fasteners. The rod sections 400, 402, 404, 406 can additionally be secured to the splicer 500, 502 by passing the fasteners 220, 222 through holes 202, 204, 206, 207, 208, 209 in the post 200, holes in the rails 300, 302, 304, 306, holes in the rod sections 400, 402, 404, 406 and holes 504, 506 in the splicers 500, 502. The second rod section 404, 406 can also be secured to the post 200 using a second fastener (not shown) through a second set of holes 206, 209 in the same post channel 210 and holes in the second rail section 304, 306 and corresponding holes in the second rod section 404, 406. The second rod section 404, 406 can either be adjacent to the first rod section 400, 402, contacting the first rod section 400, 402, or tapered such that it can be partially disposed within the hollow portion of first rod section 400, 402. In the case where the second rod section 404, 406 is partially disposed within the first rod section 400, 402, both rod sections 400, 402, 404, 406 can be attached to the post 200 using the same fastener 220.

A plurality of posts 200 are located about a length of the roadway and a plurality of rails 300 and rods 400 are disposed therebetween to form a continuous guard rail or barrier for the road. In the instance of a vehicle coming in contact with the guardrail system 100, the rails 300 and rods 400 performs similar to a net, catching or deflecting the vehicle. It has been discovered that an excessive force from a vehicle can break and/or separate the rails 300 from the posts 200, the rods 400 help absorb the load of the vehicle thereby providing an improved system for redirecting the vehicle back to the roadway or slowing the vehicle down to a complete stop.

Embodiments of the present disclosure further relate to any one or more of the following paragraphs:

1. A guardrail system for use along a roadway, comprising:

a longitudinal body having one or more longitudinal void spaces formed therein;

at least one substantially vertical post connected at one or both ends of the longitudinal body; and a longitudinal member disposed within any one of the longitudinal void spaces of the longitudinal body having a crosswise ultimate tensile strength that is at least 20% greater than the crosswise ultimate tensile strength of the longitudinal body.

2. A guardrail system for use along a roadway, comprising:

a first longitudinal body having one or more longitudinal void spaces formed therein;

a second longitudinal body having one or more longitudinal void spaces formed therein;

at least one substantially vertical post connected at one or both ends of the first longitudinal body;

a first longitudinal member disposed within any one of the longitudinal void spaces of the first longitudinal body;

a second longitudinal member disposed within any one of the longitudinal void spaces of the second longitudinal body; and a splicer that connects to both the first longitudinal member and the second longitudinal member.

3. A guardrail system for use along a roadway, comprising:

a longitudinal body having one or more longitudinal void spaces formed therein;

at least one substantially vertical post that is connected at one or both ends of the longitudinal body and having a channel wherein the longitudinal body is disposed within the channel of the post; and a longitudinal member disposed within any one of the longitudinal void spaces of the longitudinal body.

4. The system according to any one of paragraphs 1-3, wherein at least one of the longitudinal void spaces is cylindrical in shape.

5. The system according to any one of paragraphs 1-4, wherein the longitudinal member is disposed within the longitudinal void space that is cylindrical in shape.

6. The system according to any one of paragraphs 1-5, wherein the longitudinal member is a hollow stainless-steel rod.

7. The system according to any one of paragraphs 1-6, wherein the longitudinal body comprises fiber reinforced plastic.

8. The system according to any one of paragraphs 1-7, wherein at least one of the longitudinal void spaces is rectangular cuboid in shape.

9. The system according to any one of paragraphs 1-8, wherein the longitudinal void space that is rectangular cuboid in shape is at least half filled with a filler material.

10. The system according to any one of paragraphs 1-9, wherein the filler material comprises expandable polystyrene.

11. The system according to any one of paragraphs 1-10, wherein at least one substantially vertical post is connected to both the first longitudinal body and the second longitudinal body.

12. The system according to any one of paragraphs 1-11, wherein the first longitudinal member and the second longitudinal member both have a crosswise ultimate tensile strength that is at least 20% greater than the crosswise ultimate tensile strength of the second longitudinal body 13. The system according to any one of paragraphs 1-12, wherein the channel is C-shaped.

14. The system according to any one of paragraphs 1-13, wherein at least one substantially vertical post is connected to the longitudinal body through the channel of the post using a fastener.

15. The system according to any one of paragraphs 1-14, wherein the longitudinal member is also connected to the longitudinal body and the substantially vertical post using the fastener.

16. The system according to any one of paragraphs 1-15, wherein the longitudinal member has a crosswise ultimate tensile strength that is at least 20% greater than the crosswise ultimate tensile strength of the longitudinal body.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A guardrail, comprising:

a longitudinal body made from one or more plastics, the body having at least two void spaces formed through the body from a first end of the body to a second end of the body, and a structural member disposed within any one of the void spaces, the structural member being metallic, wherein the void spaces are isolated from one another by the body and at least one of the void spaces is rectangular cuboid in shape, and wherein the structural member has a length substantially the same as the length of the longitudinal body.

2. The guardrail of claim 1, wherein the two or more void spaces are non-concentric and aligned in a cross-wise direction of the body, and the structural member has a complementary shape to its surrounding longitudinal void space.

3. The guardrail of claim 1, wherein at least one of the void spaces is cylindrical in shape and is at least half filled with a filler material comprising expandable polystyrene.

4. The guardrail of claim 3, wherein the structural member is disposed within the void space that is cylindrical in shape, and the structural member has a complementary cylindrical shape configured to fit within the surrounding cylindrical void space.

5. The guardrail of claim 1, wherein the structural member is a solid stainless-steel tube or a hollow stainless-steel tube.

6. The guardrail of claim 5, wherein the longitudinal body comprises fiber reinforced plastic.

7. The guardrail of claim 1, wherein the void space that is rectangular cuboid in shape is at least half filled with a filler material.

8. The guardrail of claim 7, wherein the filler material comprises expandable polystyrene.

9. The guardrail of claim 1, wherein a cross section of the longitudinal body comprises a height and a width, the height being less than the width.

10. The guardrail of claim 9, wherein a cross section of the void space that is rectangular cuboid in shape comprises a height and a width, the height of the void space being greater than the width of the void space.

11. A guardrail system, comprising:

a longitudinal body having two or more void spaces formed therein, wherein a cross section of the longitudinal body comprises a height and a width, the height being less than the width;

a substantially vertical post connected at one end of the longitudinal body, the post having a recessed channel formed therein, the recessed channel configured to receive at least a portion of the longitudinal body; and a structural member disposed within any one of the void spaces, the structural member being metallic, and wherein at least one of the void spaces is rectangular cuboid in shape.

12. The guardrail system of claim 11, wherein the channel is C-shaped.

13. The guardrail system of claim 11, wherein the width of the structural member is generally orthogonal to a vertical axis of the post.

14. The guardrail system of claim 11, wherein at least one of the void spaces is cylindrical in shape and is at least half filled with a filler material comprising expandable polystyrene.

15. The guardrail system of claim 11, wherein the structural member is disposed within the void space that is cylindrical in shape, and the structural member has a complementary cylindrical shape configured to fit within the surrounding cylindrical void space.

16. The guardrail system of claim 11, wherein the structural member is a solid stainless-steel tube or a hollow stainless-steel tube, and wherein the structural member has a length substantially the same as the length of the longitudinal body.

17. The guardrail system of claim 11, wherein the structural member has a length substantially the same as the length of the longitudinal body.

18. The guardrail system of claim 11, wherein the substantially vertical post is connected to the longitudinal body through the channel of the post using a fastener.

19. The guardrail system of claim 18, wherein the structural member is also connected to the longitudinal body and the substantially vertical post using the fastener.

20. The guardrail system of claim 11, wherein the two or more void spaces are non-concentric and aligned in a cross-wise direction of the longitudinal body, and the structural member has a shape complementary to its surrounding void space.

21. A guardrail, comprising:

a longitudinal body made from fiber reinforced plastic;

a first longitudinal void space formed within the body, the first longitudinal void space having a circular cross-section;

a second longitudinal void space formed within the body, the second longitudinal void space having a rectangular cross-section having a height that is less than a width; and a structural tube disposed within at least one of the first and second longitudinal void spaces, wherein the first and second longitudinal void spaces are generally parallel and separated from one another by the fiber reinforced plastic of the body.

22. The guardrail of claim 21, wherein the at least one of the first and second longitudinal void spaces where the structural tube is located has a length substantially the same as the length of the longitudinal body, and the structural member also has a length substantially the same as the length of the longitudinal body.

* * * * *